United States Patent [19]

Melville

[11] 4,326,967

[45] Apr. 27, 1982

[54] LIQUID FORMULATIONS FOR DEPOSITING PERFUMES ON FABRICS

[75] Inventor: James B. Melville, Merseyside, England

[73] Assignee: Lever Brothers Company, New York, N.Y.

[21] Appl. No.: 198,012

[22] PCT Filed: Nov. 16, 1979

[86] PCT No.: PCT/GB79/00190

§ 371 Date: Jun. 24, 1980

§ 102(e) Date: Jun. 24, 1980

[87] PCT Pub. No.: WO80/01075

PCT Pub. Date: May 29, 1980

[51] Int. Cl.[3] ..... D06M 13/10

[52] U.S. Cl. ..... 252/8.8; 252/174.11

[58] Field of Search ..... 252/8.8, 173, 174.11, 252/525, 544, 547, 312

[56] References Cited

U.S. PATENT DOCUMENTS

| | | | |
|---|---|---|---|
| 3,632,396 | 1/1972 | Perez | 252/8.6 X |
| 3,697,423 | 10/1972 | Sundby | 252/8.8 |
| 3,790,484 | 2/1974 | Blair | 252/174.11 |
| 4,000,340 | 12/1976 | Murphy | 428/35 |
| 4,045,361 | 8/1977 | Watt | 252/8.8 |
| 4,151,097 | 4/1979 | Nelson | 252/8.6 |
| 4,152,272 | 5/1979 | Young | 252/8.8 |
| 4,209,417 | 6/1980 | Whyte | 252/174.11 |

FOREIGN PATENT DOCUMENTS

| | | |
|---|---|---|
| 1514276 | 4/1979 | United Kingdom . |
| 1544863 | 4/1979 | United Kingdom . |

*Primary Examiner*—P. E. Willis, Jr.

*Attorney, Agent, or Firm*—Mishrilal L. Jain; James J. Farrell; Melvin H. Kurtz

[57] ABSTRACT

A liquid formulation for depositing perfumes on fabric surfaces comprises an aqueous base, 0.5 to 30% of a fabric conditioning agent such as a fabric softener and 0.5–50% of particles consisting of an intimate mixture of an amine and a perfume, the particles having a size of 0.1–200 micron, preferably 0.1 to 5 micron. The amine may be a primary amine, a tertiary amine or a diamine. The particles are formed from a liquid melt of the amine and the perfume by dispersing in water. A benefit over particles consisting of non-ionic, cationic and perfume can be demonstrated.

23 Claims, No Drawings

LIQUID FORMULATIONS FOR DEPOSITING PERFUMES ON FABRICS

FIELD OF THE INVENTION

This invention relates to liquid formulations capable of depositing perfumes on fabric surfaces. The formulation may be used in diluted form and examples of the fabric surfaces are cotton, wool, polyacrylic, polyamide and polyester fibres. These formulations are intended for use in the rinse cycle of a fabric cleaning operation.

The liquid formulations of the invention will normally be used to provide a fabric softening effect.

Perfumes are liquid compositions consisting of a number of organic compounds, capable of appreciation by smell. The compounds are usually derived from natural sources but synthetic materials are also used. Formulations intended for the laundering of fabric will normally contain a perfume to provide a pleasant after smell on the laundered fabrics. Thus powder and liquid detergent formulations, and rinse cycle formulations contain perfumes.

It is desirable to have the perfume in a fabric treatment formulation used efficiently because it is a relatively high cost component of any formulation. In use the perfume will be present in the formulation at a relatively low concentration and dilution will cause the fabric to be in contact with a liquid system containing a very low concentration of the perfume.

BACKGROUND ART

The desirability of enhancing the effectiveness of perfumes has been acknowledged in the patent literature. United States Patent Specification No. 4,152,272 (Young) describes a fabric conditioning composition comprising particles of a wax-like carrier and a perfume. British Patent Specification No. 1,544,863 (Schilling et al) describes a fabric conditioning composition for use in an automatic laundry dryer comprising particles of a mixed cationic/non-ionic carrier and a perfume. In German patent application No. 2,732,985 of Unilever Limited a deposition system is described which provides increased deposition of materials providing a perceivable effect, for example perfumes. Amines are disclosed as matrix materials, but a cationic material is required as an essential component of the dispersed phase including the perceivable component.

DISCLOSURE OF THE INVENTION

We have now discovered that surprising good perfume deposition on fabrics can be achieved without the incorporation of cationic materials in perfume-carrying amine particles. Thus, according to the invention, there is provided a liquid formulation for depositing perfumes on fabric surfaces, wherein the formulation comprises an aqueous base having:

(i) a first dispersed phase constituting from about 0.5% to about 50% by weight of the formulation and consisting of particles having an average size of from about 0.1 micron to about 200 microns, preferably 0.1 to 5.0 micron, the particles comprising an intimate mixture of (a) from about 0.5% to about 50% by weight, based on the weight of the particles, of a perfume, and (b) from about 50% to about 99.5% by weight, based on the weight of the particles of a matrix comprising at least one water dispersible amine of the formula $$R—N\,R^1\,R^2$$

where R is an alkyl or alkenyl group having from 8 to 22 carbon atoms, $R^1$ is hydrogen or an alkyl or alkenyl group having 1 to 4 carbon atoms and $R^2$ is hydrogen or an alkyl, alkenyl or amino-alkyl group having from 1 to 22 carbon atoms, the matrix containing no added cationic material; and (ii) a second dispersed phase constituting from about 0.5% to about 30% by weight of the formulation and comprising a fabric conditioning agent.

The aqueous base will contain water as a major constituent. While it is possible for this is to be the sole component of the base, the latter will usually include other materials, for example, electrolytes, buffering agents, short chain alcohols, emulsifiers, colouring materials, bactericides, antioxidants, surface active agents and fluorescers.

The alkyl groups, alkenyl groups and alkyl portion of the amino-alkyl groups may be linear or branched. Preferably the amine is a primary or tertiary compound or a diamine, particularly a diamine of the formula $R—NH—(CH_2)_3—NH_2$, where R is as defined above. Preferred compounds are methyl dihardened tallow tertiary amine, hardened tallow primary amine, methyl, dicoco-tertiary amine, coco primary amine and N-alkyl 1:3 propylene diamines, where the alkyl group may be hardened tallow, coconut or $C_{18}/C_{20}$ mixture. The amines of utility in the invention can be solid, liquid or pasty and will have a solubility in water of not more than about 1% weight/volume. The amines will be dispersible in the aqueous base liquid.

The fabric conditioning agent may be selected from the classes of:

- dialkyl quaternary ammonium salts e.g. distearyl dimethyl ammonium chloride;
- amine salt derivatives;
- amphoteric compounds e.g. alkyl sulphobetaines and imidazoline derivatives;
- agents formed by complexing cationic and anionic species, e.g. as described in UK patent specification No. 2,007,735.

A list of suitable conditioning materials is given in German application No. 2 732 985.

The perfume may be selected from any perfumes and any mixture thereof. Examples of fabric substantive perfumes suitable for use in the present invention are listed in S Arctander, Perfume Flavors and Chemicals, Volumes I and II, published by the author, Montclair, New Jersey, USA and the Merck Index, 8th Edition, Merck & Co. Inc., Rahway N.J., USA. Deodorant perfumes such as disclosed in United States Pat. No. 4,134,838 may also be used.

A method of preparing the liquid formulation of the invention, includes the step of forming a liquid mixture of the amine and the perfume and dispersing the mixture in water.

The preferred method is to melt the amine and the perfume together and then disperse the mixture in heated water. An aid to dispersion e.g. high speed stirrers, ultrasonic agitators, vibrating reeds and continuous mixers may be used. In an alternative method the melt is solidified in bulk and then dispersed into water at ambient temperature.

BEST MODE OF CARRYING OUT THE INVENTION

Examples of formulations according to the invention will now be given. The benefit achieved by use of the invention is demonstrated using the following test method:

Three pieces of 20 cm×20 cm terry towelling (T) or bulked acrylic (BA) were rinsed in a Terg-o-Tometer (a Registered Trade Mark) for 4 minutes at 75 cycles per minute agitation. The rinse liquor was formed by adding 2 mls of formulation to 800 mls of water. The samples were spun dry for 30 seconds and dried overnight. The perfume effect was then gauged by an experienced panel and graded, from 0 to 5. The average grade was taken for each formulation.

EXAMPLE 1

0.9 g of methyl di-hardened tallow amine was melted and 0.2 g of a perfume added; the amine was maintained as near to its melting point as possible consistent with good mixing. The melt was then added to 50 g water at 70° C. and a dispersion formed with the aid of an ultrasonic probe. The average particle size was 0.4 microns. Dimethyl di-hardened tallow ammonium chloride (5 g) was dispersed in water (50 g) and the two dispersions mixed.

The perfume effect was gauged and compared to a control formulation. This control was formed by dispersing 5 g of the above quaternary ammonium salt in water (100 g) and adding 0.2 g of the same perfume.

The results of this and the following Examples 2–14 are given in the Table I which quotes the average grading for each formulation and defines the amine used by chain length of the alkyl group and type of amine.

EXAMPLE 2

Example 1 was repeated using methyl dicoco amine.

EXAMPLE 3

Example 1 was repeated using methyl di($C_{18}/C_{20}$) alkyl amine. The long chain alkyl group was formed by a 50:50 molar mixture of $C_{18}$ and $C_{20}$ alkyl chains.

EXAMPLE 4

Example 1 was repeated using hardened tallow primary amine.

EXAMPLE 5

Example 1 was repeated using coconut primary amine.

EXAMPLE 6

Example 1 was repeated using $C_{18}/C_{20}$ primary amine.

EXAMPLE 7

Example 1 was repeated using di-hardened tallow secondary amine.

EXAMPLE 8

Example 1 was repeated using di-coconut secondary amine.

EXAMPLE 9

Example 1 was repeated using dimethyl mono hardened tallow tertiary amine.

EXAMPLE 10

Example 1 was repeated using dimethyl mono-coconut tertiary amine.

EXAMPLE 11

Example 1 was repeated using dimethyl mono ($C_{18}/C_{20}$) alkyl tertiary amine.

EXAMPLE 12

Example 1 was repeated using N-hardened tallow 1:3 propylene diamine.

EXAMPLE 13

Example 1 was repeated using N-coco 1:3 propylene diamine.

EXAMPLE 14

Example 1 was repeated using N-($C_{18}/C_{20}$) 1:3 propylene diamine.

TABLE

| | Control | Alkyl Primary Amine | Dialkyl Secondary Amine | Methyl Dialkyl Tertiary Amine | Dimethyl Monoalkyl Tertiary Amine | $RNH(CH_2)_3NH_2$ | Alkyl Chain Length |
|---|---|---|---|---|---|---|---|
| T | .08 | .83 | .25 | .39 | .14 | 1.03 | HARDENED |
| BA | .47 | .92 | .72 | .64 | .58 | .97 | TALLOW |
| T | .14 | 1.0 | .42 | .36 | .31 | .95 | |
| | | | | | | | COCONUT |
| BA | .42 | .95 | .39 | .45 | .53 | 1.0 | |
| T | .42 | .80 | NO TEST | .57 | .70 | .97 | $C_{18}$ $C_{20}$ |
| BA | .49 | .59 | PERFORMED | .52 | .65 | .82 | MIXTURE |

The results demonstrate the benefit obtained when the perfume is included in a formulation as a dispersion in admixture with an amine; it will be noted the benefit achieved for some amines is demonstrated on only one of the fabric samples.

EXAMPLES 15 TO 20

Example 1 was repeated using a number of perfume/amine combinations and the results were compared with two controls. Control A was an aqueous dispersion of non-ionic/cationic/perfume particles according to our German patent specification No. 2 732 985 containing the same quantity of perfume (0.2 g), where the non-ionic was tallow alcohol 3EO (0.9 g) and the cationic was Arosurf TA 100 (dimethyl distearyl ammonium chloride) (0.05 g). Control B consisted of the same quantity of perfume dispersed in water.

The amines used were:

T 9701—methyl dihardened tallow tertiary amine
P 970—hardened tallow primary amine
D 970—hardened tallow 1:3 polypropylene diamine
D 650—coco 1:3 propylene diamine The results are given in the following table II:

TABLE II

| | | | MEAN PERFUME INTENSITIES | |
|---|---|---|---|---|
| EXAMPLE | PERFUME | AMINE | TERRY FABRIC | ACRYLIC FABRIC |
| 15 | LF 165 | T9701 | 0.83 | 0.60 |
| 16 | LF 165 | P 970 | 1.31 | 0.61 |

TABLE II-continued

| EXAMPLE | PERFUME | AMINE | MEAN PERFUME INTENSITIES TERRY FABRIC | ACRYLIC FABRIC |
|---|---|---|---|---|
| 17 | LF 165 | D 970 | 1.07 | 0.57 |
| 18 | LF 165 | D 650 | 1.30 | 0.68 |
| Control-A | LF 165 | — | 0.44 | 0.42 |
| Control-B | LF 165 | — | 0.35 | 0.26 |
| 19 | LF 166 | T9701 | 0.58 | 0.49 |
| 20 | LF 166 | P 970 | 0.54 | 0.49 |
| Control-A | LF 166 | — | 0.36 | 0.38 |
| Control-B | LF 166 | — | 0.26 | 0.28 |

The perfume formulations used were:

| LF 165 | % |
|---|---|
| Benzyl Salicylate | 5.0 |
| Musk Xylene | 5.0 |
| Galaxolide 50% | 5.0 |
| Hexyl Cinnamic Aldehyde | 10.0 |
| Lilial | 5.0 |
| Hydroxycitronellal | 6.0 |
| Methyl Dihydro Jasmonate | 8.0 |
| Citronellol Standard | 5.0 |
| Geraniol Standard | 5.0 |
| Phenyl Ethyl Alcohol | 10.0 |
| Oil of Bergamot Synthetic | 5.0 |
| Oil of Geranium Bourbon | 5.0 |
| Oil of Lavandin | 5.0 |
| Trichlor Methyl Phenyl Carbinyl Acetate | 2.0 |
| Oil of Patchouli | 1.0 |
| Linalol | 10.0 |
| Coumarin | 2.0 |
| Benzyl Acetate | 2.0 |
| Terpineol | 4.0 |
| | 100.0 |

| LF 166 | % |
|---|---|
| Amyl Cinnamic Aldehyde | 2.0 |
| Anisic Aldehyde | 1.5 |
| Benzyl Acetate | 6.0 |
| Cinnamic Alcohol | 8.0 |
| Hexyl Cinnamic Aldehyde | 4.0 |
| Hydroxycitronellal | 8.0 |
| Indole 10% | 3.0 |
| Iso Eugenol | 1.0 |
| Lilial | 7.0 |
| Linalol | 6.0 |
| Lyral | 7.0 |
| Phenyl Ethyl Alcohol | 18.0 |
| Terpineol | 16.0 |
| Tonalid | 12.0 |
| Vanillin | 0.5 |
| | 100.0 |

I claim:

1. A liquid formulation for depositing perfumes on fabric surfaces, characterised in that the formulation comprises an aqueous base having:

(i) a first dispersed phase constituting from about 0.5% to about 50% by weight of the formulation and consisting of particles having an average size of from about 0.1 micron to about 200 micron, the particles comprising an intimate mixture of (a) from about 0.5% to about 50% by weight, based on the weight of the particles, of a perfume; and (b) from about 50% to about 99.5% by weight, based on the weight of the particles of a matrix comprising at least one water dispersible amine of the formula $$R—N\ R^1 \text{ and } R^2$$

where R is an alkyl or alkenyl group having from 8 to 22 carbon atoms, $R^1$ is hydrogen or an alkyl or alkenyl group having 1 to 4 carbon atoms and $R^2$ is hydrogen or an alkyl, alkenyl or amino-alkyl group having from 1 to 22 carbon atoms; and (ii) a second dispersed phase constituting from about 0.5% to about 30% by weight of the formulation and comprising a fabric conditioning agent, and in that the matrix contains no added cationic material.

2. A liquid formulation according to claim 1, characterised in that the amine is a primary amine.

3. A liquid formulation according to claim 2, characterised in that the amine is hardened tallow primary amine, coco primary amine or $C_{18}/C_{20}$ mixture tertiary amine.

4. A liquid formulation according to claim 1, characterised in that the amine is a tertiary amine.

5. A liquid formulation according to claim 4, characterised in that the amine is methyl dihardened tallow tertiary amine, methyl dicoco tertiary amine or methyl di($C_{18}/C_{20}$ mixture) tertiary amine.

6. A liquid formulation according to claim 1, characterised in that the amine is a diamine.

7. A liquid formulation according to claim 6, characterised in that the diamine has the formula $$R—\underset{\underset{H}{|}}{N}—(CH_2)_3—NH_2$$

where R is an alkyl or alkenyl group having from 8 to 22 carbon atoms.

8. A liquid formulation according to claim 7, characterised in that R is hardened tallow, coconut or a $C_{18}/C_{20}$ mixture.

9. A liquid formulation according to claim 1, characterised in that the amine has a solubility in water of not more than 1% weight/volume.

10. A liquid formulation according to claim 1, characterised in that the fabric conditioning agent is a fabric softening agent.

11. A liquid formulation according to claim 10, characterised in that the fabric softening agent is a cationic material.

12. A liquid formulation according to claim 10 or 11, characterised in that the fabric softening agent is a dialkyl quaternary ammonium salt, an amine salt or an amphoteric fabric softening agent.

13. A liquid formulation according to claim 12, characterised in that the fabric softening agent is distearyl dimethyl ammonium chloride.

14. A liquid formulation according to claim 12, characterised in that the amphoteric fabric softening agent is an alkyl sulphobetaine or an imidazoline derivative.

15. A liquid formulation according to claim 1, characterised in that that formulation contains from about 2.0% to about 10% by weight of the formulation of the fabric conditioning agent.

16. A liquid formulation according to claim 1, characterised in that the formulation contains from about 0.7% to about 2.0%, by weight of the formulation, of said particles.

17. A liquid formulation according to claim 1, characterised in that the particles have a size in the range of from about 0.1 micron to about 5.0 micron.

18. A liquid formulation according to claim 1, characterised in that the particles contain from about 10% to about 30%, by weight of the particles, of the perfume.

19. A method of preparing a liquid formulation according to claim 1, characterised by including the steps of forming a liquid mixture of the amine and the perfume and dispersing the mixture so formed in water.

20. A method according to claim 19, characterised in that the liquid mixture is formed by melting the amine and the perfume together.

21. A method according to claim 19 or 20, characterised in that the liquid mixture is dispersed in heated water.

22. The method according to claim 19 or 20, characterised in that the liquid mixture is solidified and then dispersed in water at ambient temperature.

23. A method of depositing perfumes on fabric surfaces, characterised by treating the fabric surfaces with a liquid formulation according to claim 1.

* * * * *